US008384647B2

(12) United States Patent
Yamagishi et al.

(10) Patent No.: US 8,384,647 B2
(45) Date of Patent: Feb. 26, 2013

(54) DISPLAY DRIVER WITH IMPROVED CHARGE SHARING DRIVE ARRANGEMENT

(75) Inventors: Yasuhiko Yamagishi, Mobara (JP); Toshiki Misonou, Ichihara (JP)

(73) Assignees: Hitachi Displays, Ltd., Chiba (JP); Panasonic Liquid Crystal Display Co., Ltd., Hyogo-ken (JP)

( * ) Notice: Subject to any disclaimer, the term of this patent is extended or adjusted under 35 U.S.C. 154(b) by 428 days.

(21) Appl. No.: 12/683,492

(22) Filed: Jan. 7, 2010

(65) Prior Publication Data

US 2010/0177085 A1 Jul. 15, 2010

(30) Foreign Application Priority Data

Jan. 14, 2009 (JP) ..... 2009-005368

(51) Int. Cl.
*G09G 3/36* (2006.01)

(52) U.S. Cl. ..... 345/99; 345/98

(58) Field of Classification Search ..... 345/79, 345/96, 98–100, 103
See application file for complete search history.

(56) References Cited

U.S. PATENT DOCUMENTS

| | | | | |
|---|---|---|---|---|
| 2004/0263466 | A1* | 12/2004 | Song et al. | 345/100 |
| 2006/0007114 | A1* | 1/2006 | Shiraishi | 345/103 |
| 2006/0040520 | A1* | 2/2006 | Moh | 439/66 |
| 2009/0039959 | A1* | 2/2009 | An et al. | 330/255 |

FOREIGN PATENT DOCUMENTS

| | | |
|---|---|---|
| JP | 62-55625 | 4/1987 |
| JP | 2003-122317 | 4/2003 |

OTHER PUBLICATIONS

Yang, Shao-Sheng, Pao-Lin, Guo, Tsin-Yuan Chang, and Jin-Hua Hong. "A Multi-Phase Charge-Sharing Technique wihtout External Capacitor for Low-Power TFT-LCD Column Drivers." May 2003. Proceedings of the 2003 IEEE International Symposium on Circuits and Systems. vol. 5, pp. V365-V368.*

* cited by examiner

*Primary Examiner* — Chanh Nguyen
*Assistant Examiner* — Allison Walthall
(74) *Attorney, Agent, or Firm* — Antonelli, Terry, Stout & Kraus, LLP.

(57) ABSTRACT

In a driver circuit which controls the supply of charge to cells each of which can store a charge, the EMI (Electro Magnetic Interference) which occurs at the time of performing the charge sharing driving can be reduced. A preceding conduction means (SW13) which is controlled in response to a clock signal (CLK1) makes an output signal line corresponding to a first circuit which has positive polarity of a potential higher than a reference potential and an output signal line corresponding to a second circuit which has negative polarity of a potential lower than the reference potential electrically conductive with each other. After a lapse of a predetermined time, a succeeding conduction means (SW23) which is controlled in response to a clock signal (CLK2) makes an output signal line corresponding to a third circuit which has the positive polarity and an output signal line corresponding to a fourth circuit which has the negative polarity electrically conductive with each other.

11 Claims, 10 Drawing Sheets

DISPLAY DRIVER WITH IMPROVED CHARGE SHARING DRIVE ARRANGEMENT

CROSS-REFERENCE TO RELATED APPLICATIONS

The present application claims priority from Japanese application JP 2009-005368 filed on Jan. 14, 2009, the content of which is hereby incorporated by reference into this application.

BACKGROUND OF THE INVENTION

1. Field of the Invention

The present invention relates to a display device, and more particularly to a driver circuit which controls the supply of a charge to cells of a liquid crystal display panel, an organic EL or the like which can store the charge, a display device which uses the driver circuit, and an output signal control method.

2. Background Art

As an information communication terminal of a computer or the like or a display device of a television receiver set, a liquid crystal display device has been popularly used. The liquid crystal display device is a device which controls an image to be displayed by changing transmissivity of light by changing the alignment of liquid crystal molecules hermetically sealed between two substrates. To change the alignment of the liquid crystal molecules, it is necessary to change an electric field between the substrates by controlling a charge supplied to electrodes formed on the substrate. When the polarity of a charge to be supplied is biased, this bias shortens a lifetime of a liquid crystal panel. Accordingly, in general, a display image is controlled by a so-called inversion drive method in which the liquid crystal panel is driven by inverting the polarity of the charge. Further, to suppress electricity consumed for inversion of charge, JP-A-2003-122317 and JP-A-62-055625 disclose a drive method referred to as charge sharing drive in which electricity consumed for inversion of charge is suppressed by short-circuiting output signals having different polarities at predetermined timing.

SUMMARY OF THE INVENTION

The above-mentioned charge sharing drive plays an important role in power saving of a liquid crystal display device. However, it is known that EMI (Electro Magnetic Interference) is generated from a liquid crystal display screen during charge sharing drive. When the EMI is largely generated, there exists a possibility that the EMI influences an operation of other electronic equipments inside and outside the liquid crystal display device. Particularly, with respect to a touch-panel-type liquid crystal display device in which a touch panel screen functions as an input device when a finger of a user or the like touches the touch panel screen, the touch panel screen is arranged close to a liquid crystal display screen and hence, the touch panel screen is liable to be influenced by the EMI generated on the display screen whereby an erroneous operation is induced due to erroneous recognition of positional coordinates. Accordingly, it is necessary for such a liquid crystal display device to prevent the erroneous operation.

The invention has been made under such circumstances, and it is an object of the invention to provide a display device which can realize the reduction of EMI generated during charge sharing drive of a charge in a driver circuit which controls the supply of a charge to array of cells which can store the charge.

According to one aspect of the invention, there is provided a driver circuit which controls the supply of a charge to an array of cells which can store the charge. The driver circuit includes: a first circuit, a second circuit, a third circuit and a fourth circuit which output voltages for supplying a charge to a plurality of different cells within the array of cells; a preceding conduction means which approximates a potential of an output signal line of the first circuit and a potential of an output signal line of the second circuit to a reference potential by making the output signal line of the first circuit having either one of positive polarity which is a potential higher than a reference potential and negative polarity which is a potential lower than the reference potential and the output signal line of the second circuit having the other polarity electrically conductive with each other; and a succeeding conduction means which approximates a potential of an output signal line of the third circuit and a potential of an output signal line of the fourth circuit to a reference potential by making the output signal line of the third circuit having either one of the positive polarity and the negative polarity and the output signal line of the fourth circuit having the other polarity electrically conductive with each other after the conduction by the preceding conduction means.

Here, the array of cells which can store charges implies, for example, a pixel electrode array used in a liquid crystal display device, a light emitting element array used in an organic EL display device, a memory array of a DRAM (Dynamic Random Access Memory) or the like. In the invention, the reference potential is a potential indicative of the destination of a potential of an output signal line of each circuit when the output signal line is made electrically conductive. It is not necessary to set the reference potential to a fixed value, and the reference potential may be an AC.

Further, in the driver circuit of the invention, the above-mentioned first circuit, second circuit, third circuit and fourth circuit are formed of an inversion circuit which inverts polarity of an output signal at a fixed period respectively. An output signal of the first circuit and an output signal of the second circuit are inverted while maintaining polarities opposite to each other, and the output signal of the third circuit and an output signal of the fourth circuit are inverted while maintaining polarities opposite to each other, the preceding conduction means and the succeeding conduction means are made electrically conductive respectively at the fixed period, and a time which elapses from a point of time that the preceding conduction means is made electrically conductive to a point of time that the succeeding conduction means is made electrically conductive is short compared to the above-mentioned fixed period.

In this case, the first to fourth circuits exhibit a periodic potential change respectively, the first circuit and the third circuit are periodically changed while maintaining polarities opposite to each other, and the first circuit and the third circuit are periodically changed while maintaining polarities opposite to each other. The conduction of the preceding conduction means and the conduction of the succeeding conduction means are repeated at such a period. Here, "a time which is short compared to the fixed period" implies that the conduction is performed at timing which takes place during the same period.

The driver circuit of the invention may further include a preceding clock signal generation means which generates a clock signal for controlling timing at which the preceding conduction means is brought into an electrically conductive state, and a succeeding clock signal generation means which generates a clock signal for controlling timing at which the succeeding conduction means is brought into an electrically conductive state, wherein the clock signal has the same period as the clock signal generated by the preceding clock signal generation means and has a phase different from a phase of the clock signal generated by the preceding clock signal generation means.

Further, in the driver circuit of the invention, the cells may be classified into either one of a first cell group and a second cell group correspondingly to the arrangement of the cells within the array, a circuit for supplying charges to the cells classified into the first cell group may have timing for conduction controlled in response to a clock signal generated by the preceding clock signal generation means, and a circuit for supplying charges to the cells classified into the second cell group may have timing for conduction controlled in response to a clock signal generated by the succeeding clock signal generation means.

In this case, output signal lines of the driver circuit are, depending on the arrangement of the cells which the output signal lines control, divided into output signal lines of the first circuit and the second circuit which are made electrically conductive at timing in response to the clock signal generated by the preceding clock signal generation means and output signal lines of the third circuit and the fourth circuit which are made electrically conductive at timing in response to the clock signal generated by the succeeding clock signal generation means.

Further, in the driver circuit of the invention, the array may constitute a display screen in which each cell is formed of a pixel, the display screen may include a plurality of divided screens which are obtained by dividing the display screen by a line parallel to one side of the display screen, and the respective divided screens may correspond to the first cell group and the second cell group alternately from an edge of the display screen. In this case, the display screen is constituted of the divided screens formed of the first cell group and the second cell group arranged alternately and hence, timing for conduction is dispersed over the whole screen.

Further, in the driver circuit of the invention, the cell may be a pixel electrode for changing the alignment of liquid crystal, and the first circuit, the second circuit, the third circuit and the fourth circuit may respectively be a circuit for a liquid crystal display device which displays an image by applying voltages to the pixel electrodes. That is, the driver circuit of the invention may be used as a driver circuit for the liquid crystal display device.

Further, in the driver circuit of the invention, the cell may be a light emitting element, and the first circuit, the second circuit, the third circuit and the fourth circuit may be circuits for an organic EL display device which displays an image by applying voltages to the light emitting elements. That is, the driver circuit of the invention may be used as a driver circuit for an organic EL display device.

Further, in the driver circuit of the invention, the cell may be an electrode which constitutes one side of a capacitor, and the first circuit, the second circuit, the third circuit and the fourth circuit may be circuits for a memory device which stores information by applying voltages to electrodes which constitute one side of the capacitors. That is, the driver circuit of the invention may be used as a driver circuit for the memory device.

The liquid crystal display device of the invention is a liquid crystal display device which includes a driver element having any one of the driver circuits described above, and a liquid crystal panel which incorporates a liquid crystal material therein, and includes an array of pixel electrodes which can store charges.

Further, the liquid crystal display device of the invention may further include a conductive tape which covers the driver element, a conductive casing which is arranged on an outer edge of the liquid crystal panel, and a conductive material which electrically connects the conductive tape and the casing.

According to another aspect of the invention, there is provided an output signal control method for supplying charges to an array of cells which can store charges which includes a preceding conduction step in which a first output signal having either one of positive polarity which is a potential higher than a reference potential and a negative polarity which is a potential lower than the reference potential and a second output signal having the other polarity are made electrically conductive with each other thus approximating the potential of the first output signal and the potential of the second output signal to the reference potential, and a succeeding conduction step which comes after the preceding conduction step and in which a third output signal having either one of the positive polarity and the negative polarity and a fourth output signal having the other polarity are made electrically conductive with each other thus approximating the potential of the third output signal and the potential of the fourth output signal to the reference potential.

DETAIL DESCRIPTION OF THE EMBODIMENTS

Hereinafter, a first embodiment of the invention is explained in conjunction with FIG. 1 to FIG. 9.

Figure 1:
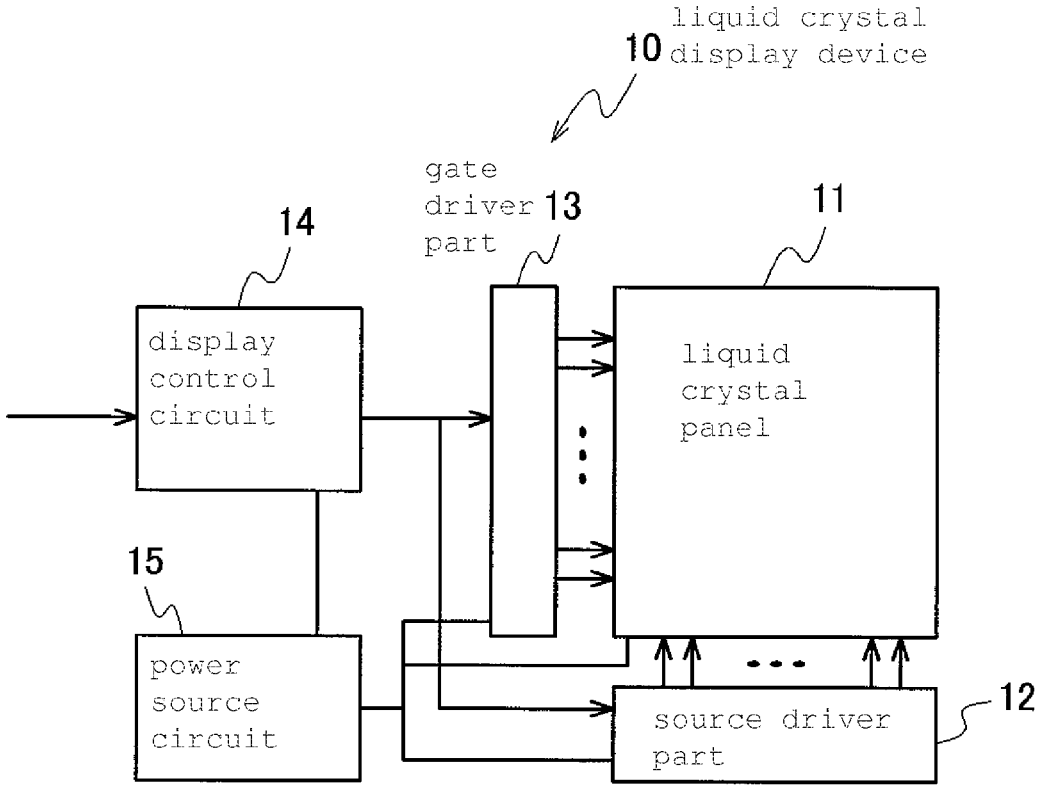
FIG. 1 is a view schematically showing a liquid crystal display device according to a first embodiment of the invention.

FIG. 1 schematically shows the constitution of a TFT (Thin Film Transistor) liquid crystal display device 10 including a driver circuit according to one embodiment of the invention. This liquid crystal display device 10 is constituted of (a) a liquid crystal panel 11 which includes TFTs (thin film transistors) and visually displays an image thereon by operating the TFTs, (b) a source driver part 12 which controls a voltage applied to drain terminals of the TFTs formed on the liquid crystal panel 11, (c) a gate driver part 13 which controls a voltage applied to gate terminals of the TFTs formed on the liquid crystal panel 11, (d) a display control circuit 14 which receives image data to be displayed and instructs the source driver part 12 and the gate driver part 13 to perform operations respectively, and (e) a power source circuit 15 which supplies electricity to the liquid crystal panel 11, the source driver part 12, the gate driver part 13, and the display control circuit 14.

Figure 2:
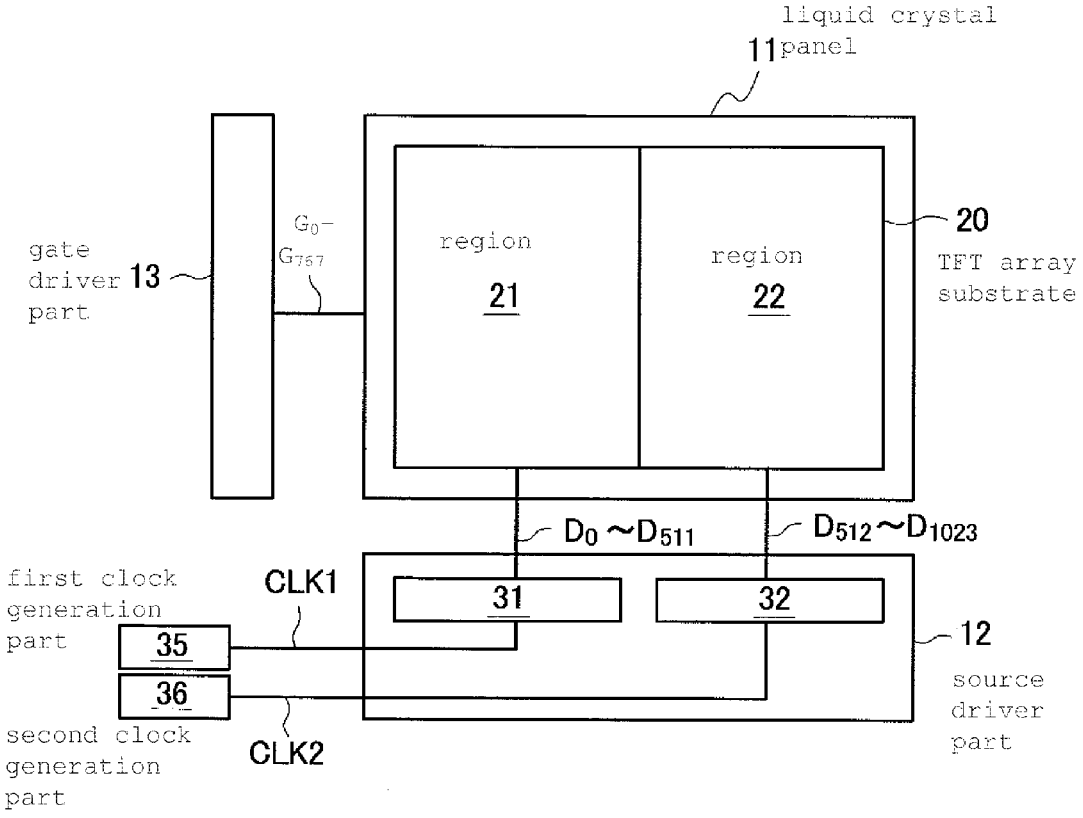
FIG. 2 is a view schematically showing a liquid crystal panel and a driver part of the liquid crystal display device shown in FIG. 1.

FIG. 2 shows the constitution of the liquid crystal panel 11, the source driver part 12 and the gate driver part 13 in more detail. The liquid crystal panel 11 is constituted of: a TFT array substrate 20 having a plurality (1024×768) of pixels with 1024 pixels arranged in the lateral direction and 768 pixels arranged in the longitudinal direction; a color filter substrate not shown in the drawing, polarizers, liquid crystal sealed between the substrates and the like. Further, as shown in the drawing, the TFT array substrate 20 includes a region 21 and a region 22. The region 21 is a region which is controlled in response to drain signals $D_0$ to $D_{511}$ which are signals outputted from a first drive part 31 in the source driver part 12, and the region 22 is a region which is controlled in response to drain signals $D_{512}$ to $D_{1023}$ which are signals outputted from a second drive part 32 in the source driver part 12. A clock signal CLK1 which is generated by a first clock generation part 35 is inputted to the first drive part 31, and a clock signal CLK2 which is generated by a second clock generation part 36 at timing different from timing of the clock signal CLK1 is inputted to the second drive part 32. Further, the gate driver part 13 outputs gate signals $G_0$ to $G_{767}$ to whole liquid crystal panel 11.

Figure 3:
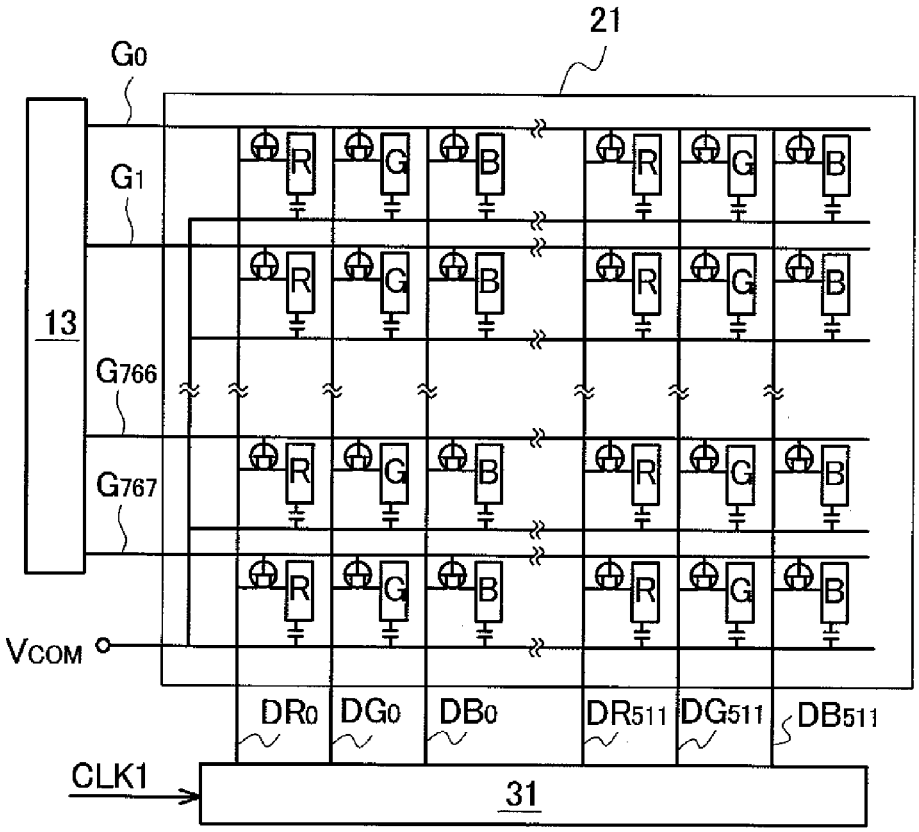
FIG. 3 is a view for explaining a display control of a region 21 of the liquid crystal panel shown in FIG. 2.

FIG. 3 is a view for explaining a display control of the region 21 of the TFT array substrate 20 by the first drive part 31 and the gate driver part 13. As shown in FIG. 3, each pixel is constituted of three kinds of transparent electrodes R, G, B for controlling a display of red, green and blue, and these transparent electrodes R, G, B are connected to sources of the corresponding TFTs respectively. Drain signal lines $DR_0$ to $DR_{511}$, $DG_0$ to $DG_{511}$ and $DB_0$ to $DB_{511}$ are connected to a drain side of the respective TFTs, and gate signal lines $G_0$ to $G_{767}$ are connected to a gate side of the respective TFTs. The first drive part 31 controls the drain signals $DR_0$ to $DR_{511}$, $DG_0$ to $DG_{511}$ and $DB_0$ to $DB_{511}$, and the gate driver part 13 controls the gate signal $G_0$ to $G_{767}$ thus controlling a display of colors corresponding to the respective pixels.

Figure 4:
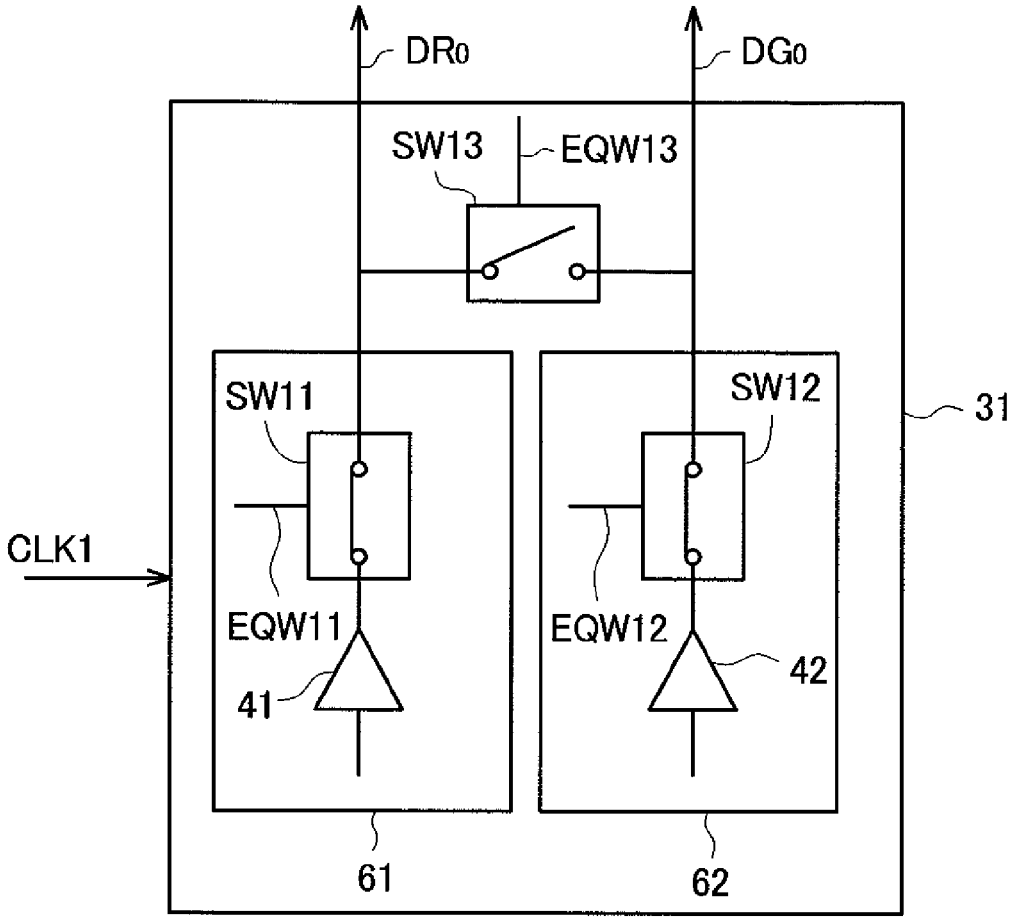
FIG. 4 is a view for explaining a control of drain signal lines $DR_0$ and $DG_0$ by a drive part 31 shown in FIG. 2.

FIG. 4 is a view for explaining a control of the drain signal $DR_0$ and $DG_0$ by the first drive part 31 shown in FIG. 3. As shown in the drawing, the first drive part 31 includes a $DR_0$-use circuit 61 which outputs a drain signal $DR_0$ to be applied to the transparent electrode R, a $DG_0$-use circuit 62 which outputs a drain signal $DG_0$ to be applied to a transparent electrode G, and a switch SW13 which makes the drain signal line $DR_0$ and the drain signal line $DG_0$ electrically conductive with each other. The $DR_0$-use circuit 61 includes an amplifier 41 and a switch SW11 for electrically disconnecting the amplifier 41 and the drain signal line $DR_0$ from each other and the $DG_0$-use circuit 62 includes an amplifier 42 and a switch SW12 for electrically disconnecting the amplifier 42 and the drain signal line $DG_0$ from each other.

The switches SW11, SW12, SW13 are respectively opened or closed in response to switch control signals EQW11, EQW12, EQW13 which are controlled by input clock signal. CLK1. When the clock signal CLK1 assumes a Low state, all switch control signals EQW11, EQW12, EQW13 become negative so that the switch SW11 and the switch SW12 assume a closed state, and the switch SW13 assumes an open state. On the other hand, when the clock signal CLK1 assumes a High state, all switch control signals EQW11, EQW12, EQW13 become active so that the switch SW11 and the switch SW12 assume an open state, and the switch SW13 assumes a closed state. Here, the drain signals $DR_0$ and the drain signal $DG_0$ are respectively controlled such that a signal which changes polarity thereof in an inverted manner is outputted periodically. Further, the drain signal $DR_0$ and the drain signal $DG_0$ are controlled such that signals having different polarities from each other are outputted at the same timing.

Figure 5:
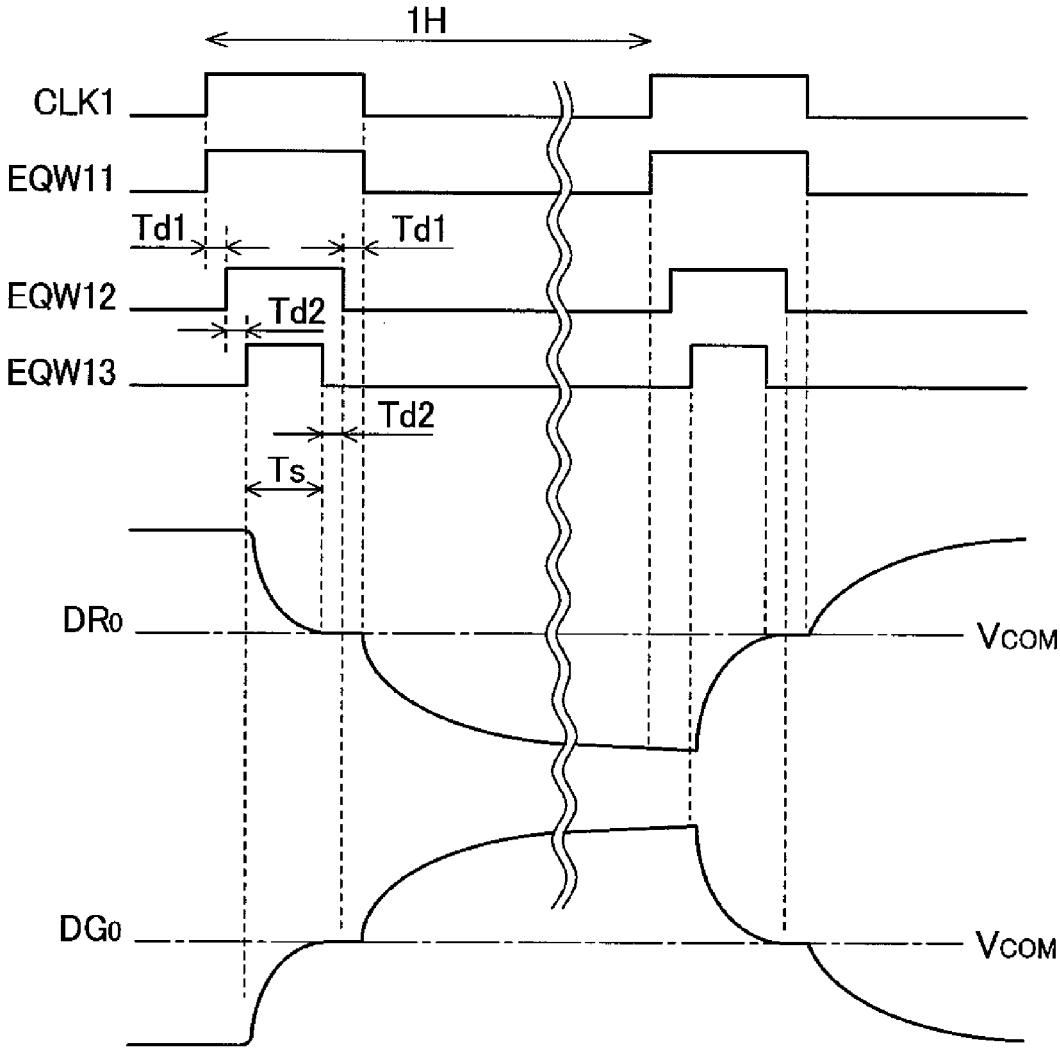
FIG. 5 is a timing chart showing a change with time of respective signals shown in FIG. 4.

FIG. 5 is a timing chart showing an operation of the clock signal CLK1, the switch control signals EQW11, EQW12, EQW13, and the drain signals $DR_0$, $DG_0$. As shown in the timing chart, firstly, when the clock signal CLK1 assumes a High state, the switch control signal EQW11 becomes active following the operation of the clock signal CLK1 so that the switch SW11 assumes an open state thus electrically disconnecting the amplifier 41 and the drain signal line $DR_0$. When the switch control signal EQW12 becomes active after a lapse of time Td1 from such an operation, the switch SW12 assumes an open state thus electrically disconnecting the amplifier 42 and the drain signal line $DG_0$. Further, when the switch control signal EQW13 becomes active after a lapse of time Td2 from such an operation, the switch SW13 assumes a closed state so that the drain signal lines $DR_0$, $DG_0$ become electrically conductive with each other. When the drain signal lines $DR_0$, $DG_0$ become electrically conductive with each other, positive (negative) polarity of the drain signal $DR_0$ and negative (positive) polarity of the drain signal $DG_0$ cancel each other so that both drain signals $DR_0$, $DG_0$ are made to approximate the reference potential Vcom. When the time Ts elapses, the switch control signal EQW13 becomes negative so that the drain signal lines $DR_0$, $DG_0$ are electrically disconnected from each other.

When the switch control signal EQW12 becomes negative after a lapse of time Td2 from such an operation, the switch SW12 assumes a closed state so that the amplifier 42 and the drain signal line $DG_0$ are electrically connected with each other whereby a voltage of positive (negative) polarity is applied to the drain signal line $DG_0$. Further, when the switch control signal EQW11 becomes negative after a lapse of time Td1 from such an operation, the switch SW11 assumes a closed state so that the amplifier 41 and the drain signal line $DR_0$ are electrically connected with each other whereby a voltage of negative (positive) polarity is applied to the drain signal line $DR_0$. Thereafter, the substantially equal operation is repeated at a horizontally synchronized period (1H).

Figure 6:
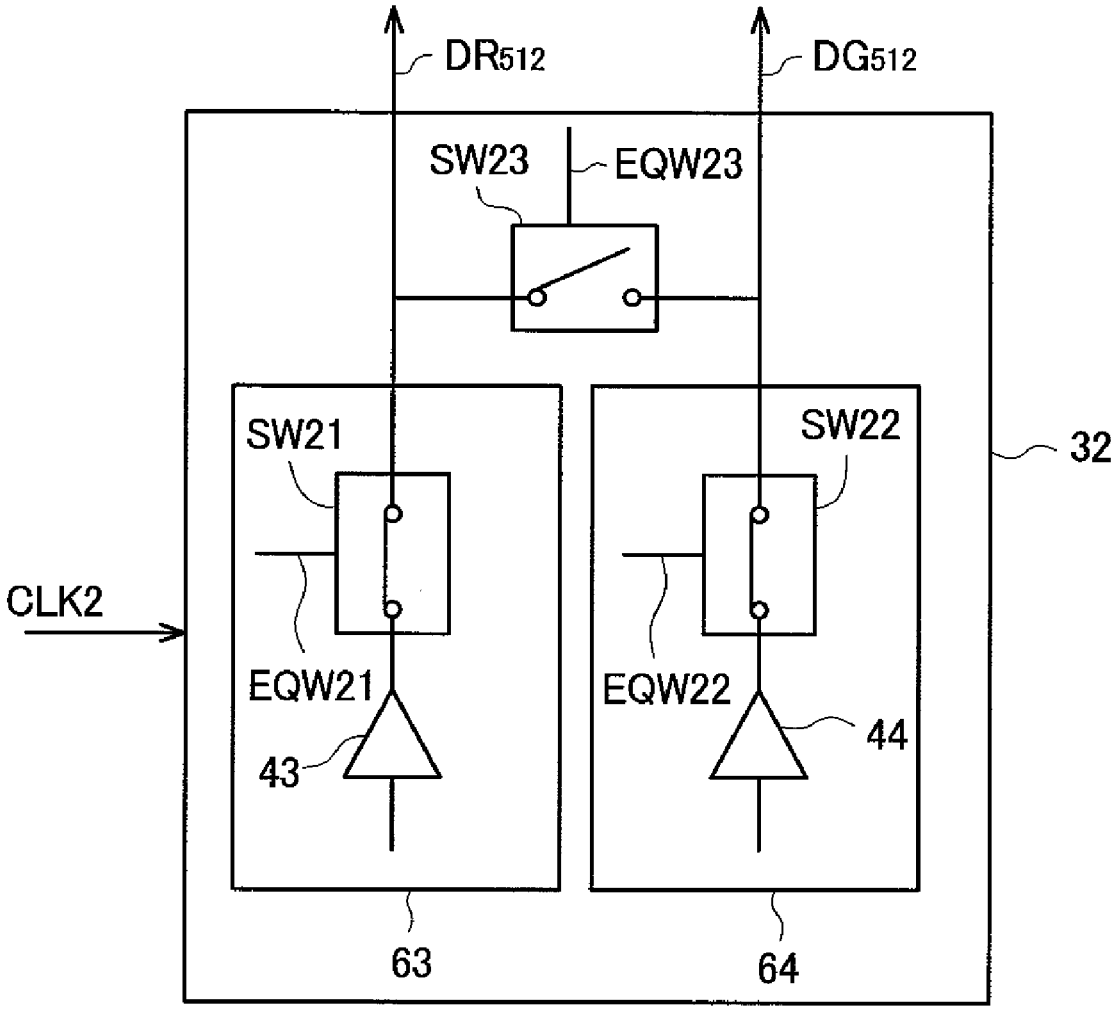
FIG. 6 is a view for explaining a control of drain signal lines $DR_{512}$ and $DG_{512}$ by a drive part 32 shown in FIG. 2.

FIG. 6 is a view for explaining a control of the drain signals $DR_{512}$, $DG_{512}$ by the second drive part 32 shown in FIG. 3. In the same manner as the first drive part 31, the second drive part 32 includes a $DR_{512}$-use circuit 63 which outputs a drain signal $DR_{512}$ to be applied to the transparent electrode R, a $DG_{512}$-use circuit 64 which outputs a drain signal $DG_{512}$ to be applied to a transparent electrode G, and a switch SW23 which makes the drain signal line $DR_{512}$ and the drain signal line $DG_{512}$ electrically conductive with each other. The $DR_{512}$-use circuit 63 includes an amplifier 43 and a switch SW21 for electrically disconnecting the amplifier 43 and the drain signal line $DR_{512}$ from each other and the $DG_{512}$-use circuit 64 includes an amplifier 44 and a switch SW22 for electrically disconnecting the amplifier 44 and the drain signal line $DG_{512}$ from each other. The switches SW21, SW22, SW23 are respectively opened or closed in response to switch control signals EQW21, EQW22, EQW23 which are controlled by input clock signal CLK2. The respective signals are operated in the substantially same manner as the signals in the timing chart shown in FIG. 5 except for that the timing of the input clock signal CLK2 differs from the timing of the input clock signal CLK1.

Figure 7:
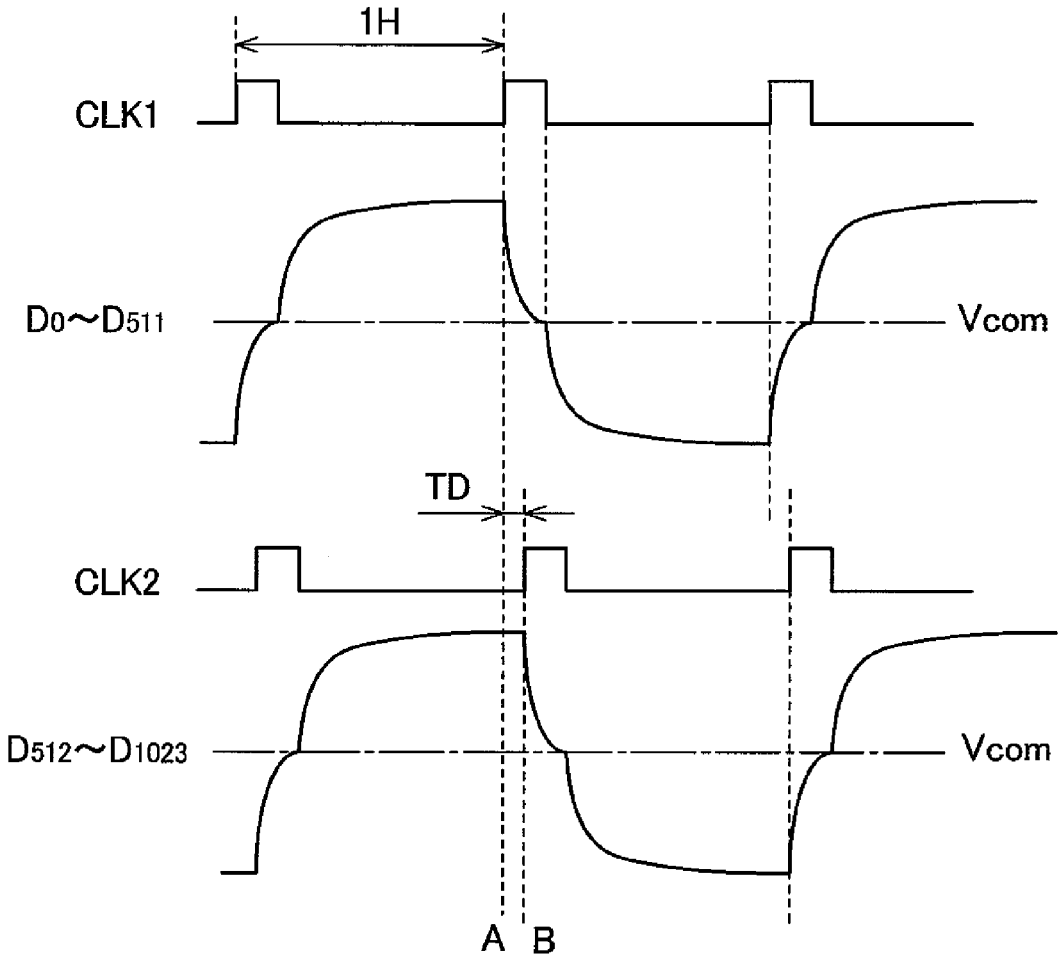
FIG. 7 is a timing chart showing a change with time of outputting of clock signals CLK1 and CLK2 and drain signals $D_0$ to $D_{511}$ and $D_{512}$ to $D_{1023}$.
Figure 8:
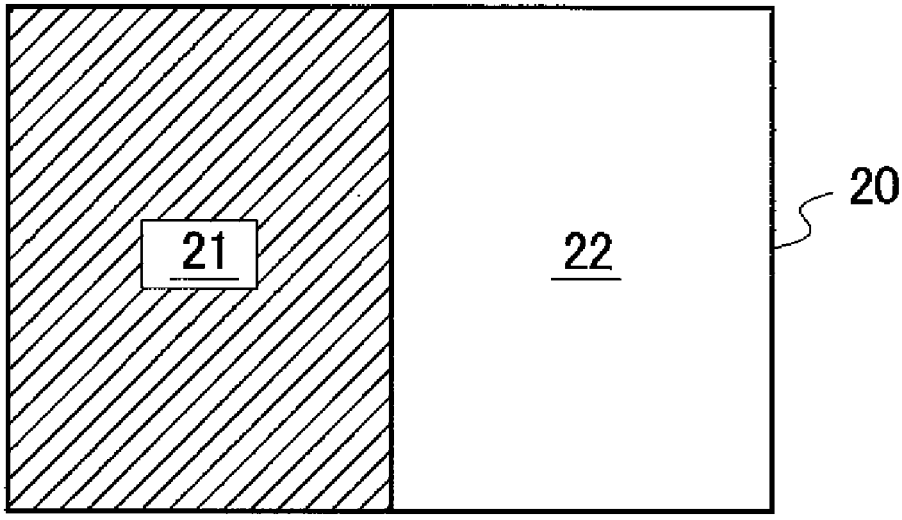
FIG. 8 is a view showing a region where pixel electrodes relating to the conduction at timing A in FIG. 7 are arranged.
Figure 9:
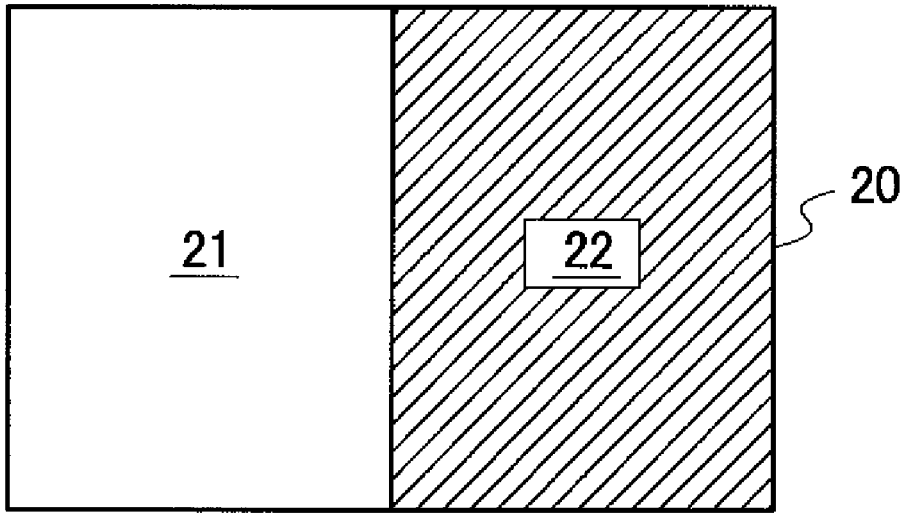
FIG. 9 is a view showing a region where pixel electrodes relating to the conduction at timing B in FIG. 7 are arranged.

FIG. 7 shows timing of the drain signals $D_0$ to $D_{511}$ outputted from the first drive part 31 when the clock signal CLK1 is inputted to the first drive part 31, and timing of the drain signals $D_{512}$ to $D_{1023}$ outputted from the second drive part 32 when the clock signal CLK2 is inputted to the second drive part 32. In the timing chart shown in FIG. 7, polarities of the drain signals are not taken into consideration. As shown in the drawing, the timing of the input clock signal CLK2 is delayed from the timing of the input clock signal CLK1 by a time TD. Accordingly, timing of charge sharing, that is, timing of making the switch SW13 and the switch SW23 electrically conductive (closed) is also delayed by the time TD so that timing at which the potential of the drain signals $D_0$ to $D_{511}$ is shifted to the reference potential Vcom and timing at which the potential of the drain signals $D_{512}$ to $D_{1023}$ is shifted to the reference potential Vcom differ from each other by the time TD. That is, the charge sharing is performed in the region 21 which is controlled by the first drive part 31 at timing A in FIG. 7 (hatched portion in FIG. 8) and, thereafter, the charge sharing is performed in the region 22 which is controlled by the second drive part 32 at timing B in FIG. 7 (hatched portion in FIG. 9). Accordingly, it is possible to reduce the occurrence of EMI compared to a case where the charge sharing is performed over the whole surface of the TFT array substrate 20 simultaneously.

Figure 10:
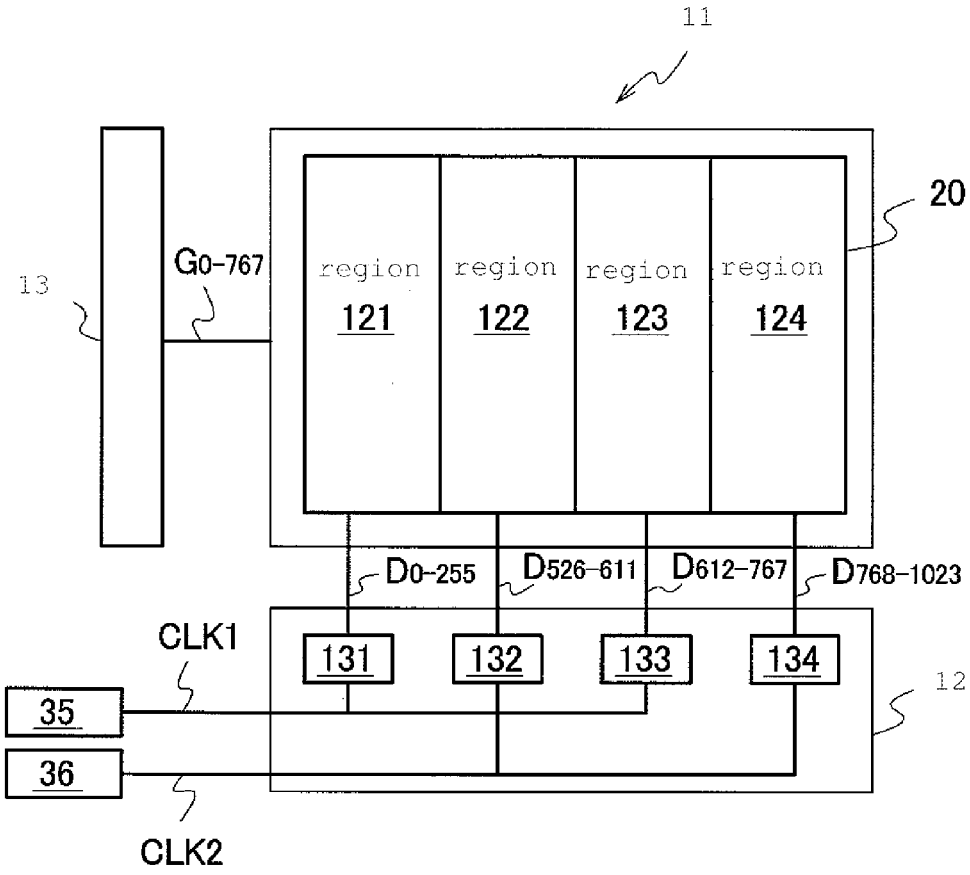
FIG. 10 is a view showing a case where the number of division of a TFT array substrate is four in a second embodiment.

Hereinafter, the second embodiment of the invention is explained in conjunction with FIG. 10.

In the above-mentioned first embodiment, the TFT array substrate 20 is divided into two regions consisting of the region 21 and the region 22. However, as shown in FIG. 10, the TFT array substrate 20 may be divided into four regions consisting of regions 121 to 124. In this case, as shown in the drawing, clock signals CLK1, CLK2 are respectively divided and divided signals are respectively inputted alternately to a first drive part 131 to a fourth drive part 134 which control the drain signals D supplied to the regions 121 to 124. Accordingly, the EMI which occurs simultaneously can be dispersed thus reducing the EMI as a whole. Further, the invention is not limited to the above-mentioned embodiment, and a case where the number of division of the TFT array substrate exceeds four and a case where clock signals which differ in timing are applied to drive parts also fall within the scope of the technical concept of the invention.

Hereinafter, a third embodiment of the invention is explained in conjunction with FIG. 11.

Figure 11:
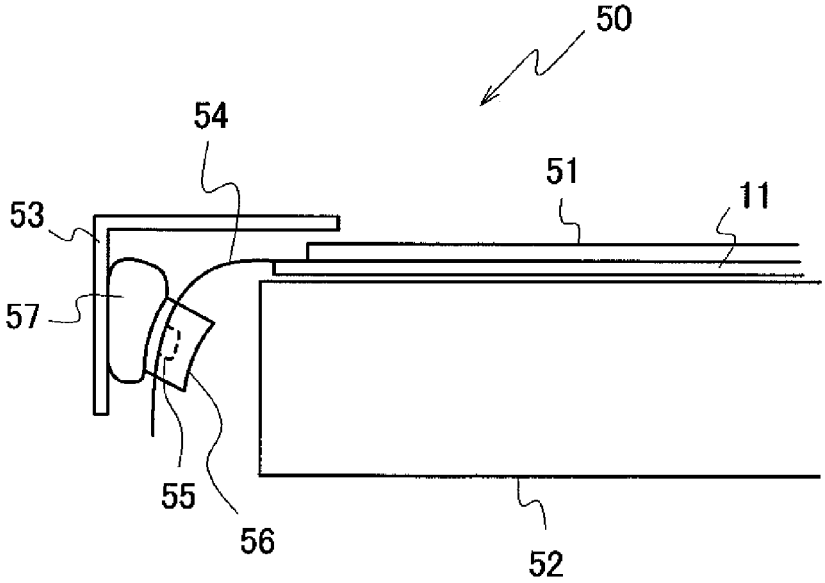
FIG. 11 is a view schematically showing a touch-panel-type liquid crystal display device according to a third embodiment of the invention.

FIG. 11 schematically shows a touch-panel-type liquid crystal display device 50 which uses the liquid crystal panel 1 according to the above-mentioned first embodiment or second embodiment. As shown in FIG. 11, the touch-panel-type liquid crystal display device 50 includes: (i) a liquid crystal panel 11 having the structure substantially equal to the structure of the liquid crystal panel according to the first embodiment or second embodiment; (ii) a touch panel part 51 which functions as an input device when a finger of a user or the like touches the touch panel part 51; (iii) a backlight unit 52 which radiates light from a back surface side of the liquid crystal panel 11; (iv) a metal frame portion 53 which constitutes a housing of the touch-panel-type liquid crystal display device 50; (v) a flexible printed circuit board 54 which constitutes a film-like wiring circuit such as a COF (Chip On Film) or a TCP (Tape Carrier Package); (vi) a driver IC 55 which is mounted on the flexible printed circuit board 54 and includes circuits such as the above-mentioned gate driver part 13, and the source driver part; (vii) a conductive tape 56 which is wound around the flexible printed circuit board 54 so as to cover the driver IC 55; and (viii) a conductive cushion spacer 57 which is brought into contact with the metal frame portion 53 and the conductive tape 56 and conducts and diffuses electromagnetic waves or the like.

The above-mentioned EMI which occurs due to charge sharing occurs not only from a front surface of the liquid crystal panel 11 but also in the driver IC 55 which includes the switch SW13 or SW23 for electric conduction. Accordingly, by adopting the constitution shown in FIG. 11, electromagnetic waves which are generated at the time of charge sharing in the driver IC 55 are sequentially conducted through the conductive tape 56, the conductive cushion spacer 57 and the metal frame portion 53 and dispersed so that the electromagnetic waves are reduced. Accordingly, by adopting the above-mentioned constitution of this embodiment together with the liquid crystal panel of the first or second embodiment, it is possible to synergistically reduce the occurrence of the EMI.

Hereinafter, a fourth embodiment of the invention is explained in conjunction with FIG. 12.

In the above-mentioned first to third embodiments of the invention, the example which uses the liquid crystal display device is explained. However, the invention is also applicable to a device which arranges cells which can store charges in the same manner as the liquid crystal display device such as, for example, an organic EL display device which performs a display using light emitting elements or a memory device such as a RAM (Random Access Memory).

Figure 12:
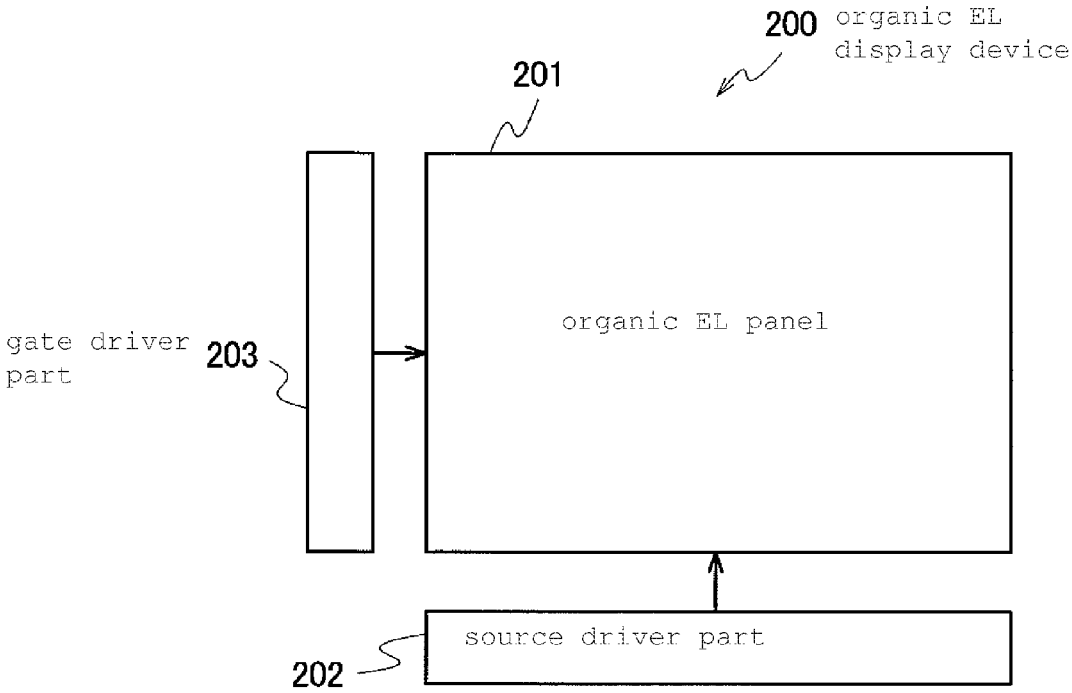
FIG. 12 is a view schematically showing an organic EL display device according to a fourth embodiment of the invention.

FIG. 12 shows a case where the invention is applied to an organic EL display device 200. An organic EL panel 201 is configured such that the transparent electrodes R, G, B (see FIG. 3) of the liquid crystal panel 11 are replaced with light emitting elements R0, G0, B0. In the same manner as the above-mentioned first embodiment, the organic EL display device 200 includes a source driver part 202 and a gate driver part 203. Accordingly, in the same manner as the first embodiment and the second embodiment, it is possible to reduce the EMI by applying the driver circuit of the invention at the time of performing the charge sharing.

Hereinafter, a fifth embodiment of the invention is explained in conjunction with FIG. 13.

Figure 13:
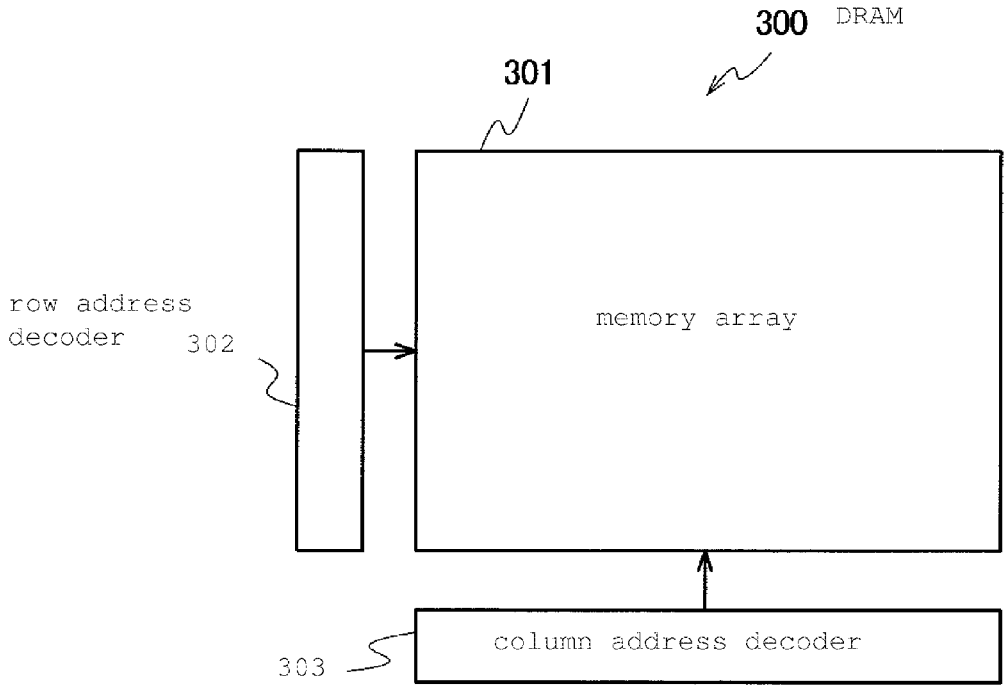
FIG. 13 is a view schematically showing a DRAM (Dynamic Random Access Memory) according to a fifth embodiment of the invention.

FIG. 13 shows a case where the invention is applied to a DRAM 300 which is formed of a volatile memory. A memory array 301 is an array in which each cell includes a field effect transistor (FET) and a capacitor, and an access to the respective cells is made by a row address decoder 302 and a column address decoder 303. Accordingly, in the same manner as the first embodiment and the second embodiment, it is possible to reduce the EMI by applying the driver circuit of the invention at the time of performing the charge sharing.

As has been explained heretofore, in the driver circuit of the invention, in controlling the supply of charge to the array of cells which can store the charge, the signal line having the potential higher than the reference potential and the signal line having the potential lower than the reference potential are controlled and are made electrically conductive with each other at timing of the clock signal CLK1 by the first drive part 1 and, thereafter, with a time delay, the signal line having the potential higher than the reference potential and the signal line having the potential lower than the reference potential are controlled and are made electrically conductive with each other at timing of the clock signal CLK2 by the second drive part 2. Accordingly, the driver circuit of the invention can disperse the timing at which the EMI occurs in the conduction (charge sharing operation) thus reducing the influence of the EMI.

The above-mentioned first and second embodiments adopt the drive method where the reference potential Vcom is set to a fixed value. However, the invention is also applicable to charge sharing in a case where the reference potential Vcom is set to an AC.

The above-mentioned first and second embodiments adopt the so-called dot inversion drive method as a method of inversion driving of charging polarity. However, the invention is applicable to other embodiments which adopt a frame inversion drive method, a horizontal line inversion drive method, a vertical inversion drive method or other drive method.

The above-mentioned first to third embodiments relate to the display device which performs the liquid crystal display using the TFTs. However, the invention is also applicable to a liquid crystal display device which performs a display by other methods such as a method which uses TFDs (Thin Film Diodes) or MIM (Metal Insulated Metal) having a charge sharing function.

As has been explained heretofore, the driver circuit, the liquid crystal display device which uses the driver circuit and the output signal control method of the invention are applicable to the device which has the array of cells which can store the charge such as the liquid crystal display panel, the organic EL panel or the DRAM.

What is claimed is:

1. A display device comprising:

a panel having a plurality of cells each of which can store a charge therein; and a driver circuit which supplies the charge to the panel, wherein the driver circuit includes:

a first circuit, a second circuit, a third circuit and a fourth circuit which output voltages of positive polarity or negative polarity with respect to a reference potential for supplying the charge to the cells;

a first output signal line to which the voltage having either one of positive polarity and negative polarity is supplied from the first circuit;

a second output signal line to which the voltage having the other polarity is supplied from the second circuit;

a first switching element which makes the first output signal line and the second output signal line electrically conductive with each other for charge sharing of the first and second output signal lines;

a third output signal line to which the voltage having either one of positive polarity and negative polarity is supplied from the third circuit;

a fourth output signal line to which the voltage having the other polarity is supplied from the fourth circuit;

a second switching element which makes the third output signal line and the fourth output signal line electrically conductive with each other for charge sharing of the third and fourth output signal lines;

a third switching element which electrically connects the first circuit to the first output signal line;

a fourth switching element which electrically connects the second circuit to the second output signal line;

a fifth switching element which electrically connects the third circuit to the third output signal line; and a sixth switching element which electrically connects the fourth circuit to the fourth output signal line, wherein the second switching element is brought into an electrically conductive state after the first switching element is brought into an electrically conductive state, the first switching element is configured to assume an open state so that the first output signal line and the second output signal line are electrically disconnected with each other after charge sharing of the first and second output signal lines, the third switching element is configured to assume a close state so that the first circuit and the first output signal line are electrically connected with each other after the open state of the first switching element, and the fourth switching element is configured to assume a close state so that the second circuit and the second output signal line are electrically connected with each other after the close state of the third switching element.

2. A display device according to claim 1, wherein the first circuit, the second circuit, the third circuit and the fourth circuit invert polarity of an output signal at a fixed period respectively, and the output signal of the first circuit and the output signal of the second circuit are inverted while maintaining polarities opposite to each other and, at the same time, the output signal of the third circuit and the output signal of the fourth circuit are inverted while maintaining polarities opposite to each other.

3. A display device according to claim 1, wherein:

the second switching element is configured to assume an open state so that the third output signal line and the fourth output signal line are electrically disconnected with each other after charge sharing of the third and fourth output signal lines, the fifth switching element is configured to assume a close state so that the third circuit and the third output signal line are electrically connected with each other after the open state of the second switching element, and the sixth switching element is configured to assume a close state so that the fourth circuit and the fourth output signal line are electrically connected with each other after the close state of the fifth switching element.

4. A display device according to claim 3, wherein the display device further includes:

a first clock signal generation means which generates a clock signal for controlling timing at which the first switching element is brought into an electrically conductive state; and a second clock signal generation means which generates a clock signal for controlling timing at which the second switching element is brought into an electrically conductive state, wherein the clock signal has the same period as the clock signal generated by the first clock signal generation means and has a phase different from a phase of the clock signal generated by the first clock signal generation means.

5. A display device according to claim 3, wherein the display device further includes:

a first clock signal generation means which generates a clock signal for controlling timing at which the first switching element is brought into an electrically conductive state; and a second clock signal generation means which generates a clock signal for controlling timing at which the second switching element is brought into an electrically conductive state, wherein the cells are classified into either one of a first cell group and a second cell group, a circuit for supplying the charge to the cells classified into the first cell group has the timing at which the first switching element is brought into an electrically conductive state controlled in response to the clock signal generated by the first clock signal generation means.

6. A display device according to claim 3, wherein the display device further includes:

a first clock signal generation means which generates a clock signal for controlling timing at which the first switching element is brought into an electrically conductive state; and a second clock signal generation means which generates a clock signal for controlling timing at which the second switching element is brought into an electrically conductive state, wherein the cells are classified into either one of a first cell group and a second cell group, a circuit for supplying the charge to the cells classified into the first cell group has the timing at which the first switching element is brought into an electrically conductive state controlled in response to the clock signal generated by the first clock signal generation means; and a circuit for supplying the charge to the cells classified into the second cell group has the timing at which the second switching element is brought into an electrically conductive state controlled in response to the clock signal generated by the second clock signal generation means.

7. A display device according to claim 3, wherein the cell includes a pixel electrode for changing the alignment of liquid crystal, and the first circuit, the second circuit, the third circuit and the fourth circuit display an image by applying voltages to the pixel electrodes respectively.

8. A display device according to claim 3, wherein the cell is a light emitting element, and the first circuit, the second circuit, the third circuit and the fourth circuit display an image by applying voltages to the light emitting elements respectively.

9. A display device according to claim 3, wherein the cell includes an electrode which constitutes one side of a capacitor, and the first circuit, the second circuit, the third circuit and the fourth circuit store information by applying a voltage to the electrode which constitutes one side of each capacitor.

10. A display device according to claim 3, wherein a display device further includes:

a conductive tape which covers a drive element;

a conductive casing which is arranged on an outer periphery of the panel; and a conductive material which electrically connects the conductive tape and the casing with each other.

11. A display device comprising:

a panel having a plurality of cells each of which can store a charge therein; and a driver circuit which supplies the charge to the panel, wherein the driver circuit includes:

a first circuit, a second circuit, a third circuit and a fourth circuit which output voltages of positive polarity or negative polarity with respect to a reference potential for supplying the charge to the cells;

a first output signal line to which the voltage having either one of positive polarity and negative polarity is supplied from the first circuit;

a second output signal line to which the voltage having the other polarity is supplied from the second circuit;

a first switching element which makes the first output signal line and the second output signal line electrically conductive with each other for charge sharing of the first and second output signal lines;

a third output signal line to which the voltage having either one of positive polarity and negative polarity is supplied from the third circuit;

a fourth output signal line to which the voltage having the other polarity is supplied from the fourth circuit;

a second switching element which makes the third output signal line and the fourth output signal line electrically conductive with each other for charge sharing of the third and fourth output signal lines;

a third switching element which electrically connects the first circuit to the first output signal line;

a fourth switching element which electrically connects the second circuit to the second output signal line;

a fifth switching element which electrically connects the third circuit to the third output signal line; and a sixth switching element which electrically connects the fourth circuit to the fourth output signal line, wherein:

the second switching element is brought into an electrically conductive state after the first switching element is brought into an electrically conductive state, the second switching element is configured to assume an open state so that the third output signal line and the fourth output signal line are electrically disconnected with each other after charge sharing of the third and fourth output signal lines, the fifth switching element is configured to assume a close state so that the third circuit and the third output signal line are electrically connected with each other after the open state of the second switching element, and the sixth switching element is configured to assume a close state so that the fourth circuit and the fourth output signal line are electrically connected with each other after the close state of the fifth switching element.

* * * * *